United States Patent [19]

Wuthrich

[11] 4,034,553

[45] July 12, 1977

[54] STEM DETENT ARRANGEMENT FOR WRISTWATCH

[75] Inventor: Paul Wuthrich, Watertown, Conn.

[73] Assignee: Timex Corporation, Waterbury, Conn.

[21] Appl. No.: 591,552

[22] Filed: July 11, 1975

[51] Int. Cl.[2] ..... G04B 37/08; G04B 23/12; G04B 27/00

[52] U.S. Cl. ..... 58/88 B; 58/57.5; 58/85.5; 58/90 B

[58] Field of Search ..... 58/85.5, 88 B, 90 B, 58/57, 57.5, 58, 95 R, 99

[56] References Cited

U.S. PATENT DOCUMENTS

| | | | |
|---|---|---|---|
| 1,294,895 | 2/1919 | Golden | 58/95 R |
| 3,151,441 | 10/1964 | Tsuzuki | 58/85.5 |
| 3,192,703 | 7/1965 | Dicke | 58/85.5 |
| 3,673,790 | 7/1972 | Gasser | 58/85.5 |
| 3,707,840 | 1/1973 | Miyasaka | 58/99 |

*Primary Examiner*—E. S. Jackmon
*Attorney, Agent, or Firm*—William C. Crutcher

[57] ABSTRACT

A three position detent arrangement for facilitating axial positioning of the rotatable stem of a wristwatch in order to enable the wearer to locate the proper axial position. Frusto-conical surfaces of selectively different included angles are employed to provide steep and shallow slopes for the detent spring, so that the steeper slopes require relatively higher force to move from the intermediate position to either end position. This enables the operator to locate any of the three positions with assurance.

2 Claims, 1 Drawing Figure

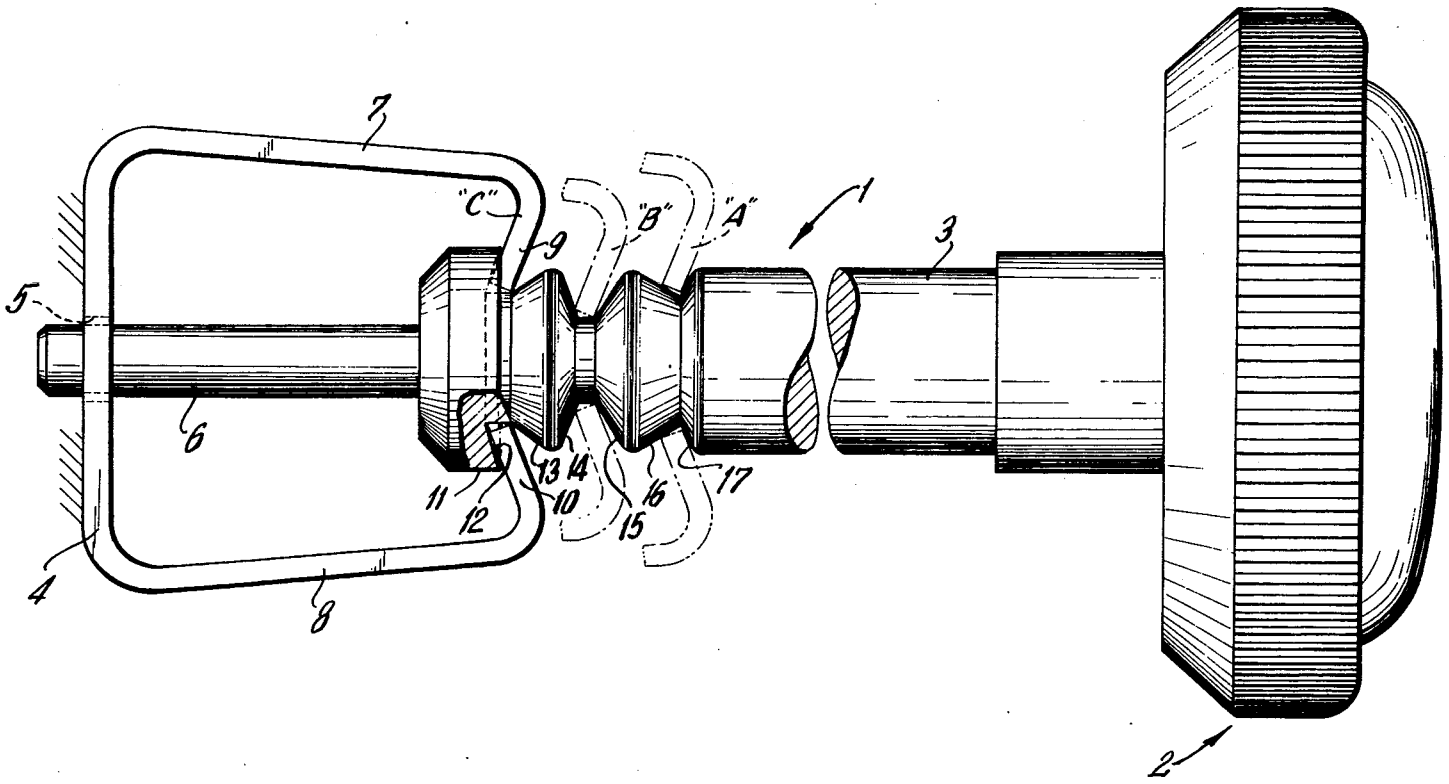
"A"
"B"
"C"
1
2
3
4
5
6
7
8
9
10
11
12
13
14
15
16
17

STEM DETENT ARRANGEMENT FOR WRISTWATCH

BACKGROUND OF THE INVENTION

This invention relates generally to horological instruments, and more particularly to a detenting aggrangement for the stem of a wristwatch for a three position stem. As is well known in the art, the ordinary mechanical watch has a stem which may be rotated to wind the watch in the inner position, but which may be pulled out to engage a setting pinion so that the stem performs a different function in the outer position. The arrangements which detent the stem in the inner and outer axial positions usually employ spring fingers cooperating with frusto-conical surfaces on the stem and such surfaces have employed different slopes or included angles as shown in British Pat. No. 16,784 (A.D. 1915) to Depollier, and also as shown in U.S. Pat. No. 3,360,922 issued Jan. 2, 1968 to Rogers. Detenting arrangements have also been shown in the art for operatively positioning the watch stem in three different axial positions so that it can be rotated to perform three different functions, examples being shown in the aforementioned Rogers patent and also in U.S. Pat. No. 3,866,407 issued Feb. 18, 1975 to Wuthrich and assigned to the present assignee.

There are a number of applications where three position stem detents are needed in wristwatches, such as setting alarms, time zone hands, operating switches in different modes for solid state electronic watches, and so forth. When the watch operator manually pushes or pulls the watch crown, it is quite easy to locate the innermost and outermost positions. However the operator is never quite sure whether he has the stem in the intermediate position and this usually requires several tries.

Accordingly, one object of the present invention is to provide an improved detent arrangement for the stem of a wristwatch.

Another object of the invention is to provide an improved detent for facilitating manual location of the intermediate position of a three position detent in a watch stem.

DRAWING

The invention will best be understood by reference to the following description, taken in connection with the accompanying drawing in which the single FIGURE is a partial view of a watch stem and crown illustrating the detenting arrangement.

SUMMARY OF THE INVENTION

Briefly stated, the invention is practiced by providing in a watch stem with associated radially biased spring members, a first inwardly facing relatively shallow frusto-conical surface, a second outwardly facing relatively steep frusto-conical surface, a third inwardly facing relatively steep frusto-conical surface, and a fourth outwardly facing relatively shallow frusto-conical surface. The first and fourth shallow surfaces permit easy detenting from inner or outer position to the intermediate position, while the second and third surfaces require relatively high detenting force to move the stem from the intermediate position to the inner or outer positions.

DESCRIPTION OF THE PREFERRED EMBODIMENT

Referring now to the single FIGURE of the drawing, portions of a watch stem 1 are shown which are located inside a watchcase (not shown), with an attached crown 2 which is outside the watchcase and adapted to be manipulated by the wearer of the watch. The stem has an internal spindle 3 which is adapted to carry pinion gears, switch contacts or other devices which are not material to the present invention so that different functions can be performed by the operator, including performing no function at all, depending upon which of several axial positions the stem is placed in by pushing or pulling.

Location of the stem in the proper axial position is facilitated by a stem detenting bracket 4 which is attached to structural parts of the watch (not shown) and provided with an opening 5 to allow axial sliding of a reduced diameter spindle portion 6 forming part of the stem. The spring bracket includes two radially biased spring arms 7, 8 with inwardly directed fingers 9, 10 which engage a detenting section of the stem. The axially outermost position of the stem is determined by a flange 11 which is undercut to provide a negatively sloping surface 12.

Specially selected alternating frusto-conical detenting surfaces according to the invention, include a first inwardly (i.e. toward the interior of the watch) facing frusto-conical surface 13 having a relatively shallow slope, followed by a second outwardly facing frusto-conical surface 14 or a relatively steep slope, followed by an inwardly facing frusto-conical surface 15 of a relatively steep slope, followed by a fourth outwardly facing frusto-conical surface 16 of a relatively shallow slope. The stem may further include a final abutment surface 17 which determines the innermost position of the stem, unless other means are used to locate the innermost position, such as a stop at the end of spindle 6 (not shown).

OPERATION

The operation of the invention will better be understood by considering the position of the detent spring fingers 9, 10 as the stem is axially moved to various positions. However rather than showing the stem in various positions, the detent fingers 9, 10 are shown in three different positions, it being understood that the stem rather than the fingers changes position. These fingers 9, 10 are shown in the stem innermost position A, the intermediate position B and the stem outermost position C.

According to the invention, slope 13 is shallow and permits relatively easy detenting from position C to position B. Slope 15 is steep requiring relatively high force to detent from position B to position A. Therefore this prevents accidental detenting from position C directly to position A, when detenting from position C to position B was in fact desired.

Going in the opposite direction, slope 16 is shallow permitting relatively easy detenting from position A to position B. Slope 14 is steep requiring relatively high force to detent from position B to position C. Therefore this prevents accidental detenting from position A directly to position C, when detenting from position A to position B was in fact desired.

The operator of course, knows when he is in position A or position C without difficulty, since these are the end positions. The negative slope 12 on flange 11 permits the stem from pulling out of the case entirely.

It will be understood that the terms "steep" and "shallow" are relative terms, and no precise included conical angles for the frusto-conical surfaces can be stated since this depends upon the type and flexibility of the detenting spring.

While there has been shown what is considered to be the preferred embodiment of the invention, it is desired to cover in the appended claims all such modifications as fall within the true spirit and scope of the invention.

I claim:

1. In a spring detenting arrangement for an axially slideable rotatable watch stem having a manually operated crown and having radially biased spring detenting means, the improvement comprising a plurality of alternately facing frusto-conical surfaces coaxially disposed in succession along said stem, including a first shallow frusto-conical surface, a second steep frusto-conical surface, a third steep frusto-conical surface, and a fourth shallow frusto-conical surface, the shallowness and the steepness of said surfaces being relative to each other and relative to the stem axis, said stem also including a flange with a negatively sloping surface adjacent and spaced from said first surface and adapted to prevent inadvertent disengagement of the stem from the watch.

2. The combination according to claim 1, wherein said spring biasing means comprises a pair of flexible spring members having inwardly directed fingers engageable with said surfaces from opposite sides thereof.

* * * * *